US010923034B2

(12) United States Patent
Liu et al.

(10) Patent No.: US 10,923,034 B2
(45) Date of Patent: Feb. 16, 2021

(54) DRIVING SYSTEM OF DISPLAY PANEL AND DISPLAY DEVICE USING THE SAME

(71) Applicant: SeeYa Optronics Co., Ltd., Shanghai (CN)

(72) Inventors: Ping-Lin Liu, Shanghai (CN); Haodong Zhang, Shanghai (CN)

(73) Assignee: SEEYA OPTRONICS CO., LTD., Shanghai (CN)

( * ) Notice: Subject to any disclaimer, the term of this patent is extended or adjusted under 35 U.S.C. 154(b) by 0 days.

(21) Appl. No.: 16/728,002

(22) Filed: Dec. 27, 2019

(65) Prior Publication Data

US 2020/0193908 A1 Jun. 18, 2020

Related U.S. Application Data

(63) Continuation-in-part of application No. PCT/CN2018/096547, filed on Jul. 21, 2018.

(51) Int. Cl.
*G09G 3/3258* (2016.01)
*G09G 3/36* (2006.01)

(52) U.S. Cl.
CPC ..... *G09G 3/3258* (2013.01); *G09G 3/3648* (2013.01); *G09G 2310/0259* (2013.01); *G09G 2320/0673* (2013.01)

(58) Field of Classification Search
USPC ..... 345/690
See application file for complete search history.

(56) References Cited

U.S. PATENT DOCUMENTS 5,477,234 A * 12/1995 Suzuki ..... G09G 3/2011 345/211
2004/0227711 A1* 11/2004 Kudo ..... G09G 3/3648 345/87

(Continued)

FOREIGN PATENT DOCUMENTS

CN 1711575 A 12/2005
CN 1949330 A 4/2007

(Continued)

OTHER PUBLICATIONS

Int'l. Search Report for PCT/CN2018/096547, dated Apr. 16, 2019.

*Primary Examiner* — Deeprose Subedi
(74) *Attorney, Agent, or Firm* — Blue Filament Law PLLC

(57) ABSTRACT

The present disclosure provides a driving system. The driving system includes: a voltage generating circuit configured to generate $(2^{m+k}+1)$ initial grayscale voltages; a ramp voltage curve generating circuit configured to generate $(2^m+1)$ ramp voltage curves by using the $(2^{m+k}+1)$ initial grayscale voltages based on k-bit data of received pixel data, each ramp voltage curve of the $(2^m+1)$ ramp voltage curves including $2^k$ step voltages; a source driving circuit configured to generate additional $2^n$ ramp voltage curves by using any two adjacent ramp voltage curves of the $(2^m+1)$ ramp voltage curves based on m-bit data of the received pixel data; and an output control circuit configured to select a grayscale voltage of the ramp voltage curves based on the received pixel data and send the selected grayscale voltage to the data signal input terminals of the pixel circuit.

13 Claims, 12 Drawing Sheets

(56) References Cited

U.S. PATENT DOCUMENTS

| | | | | |
|---|---|---|---|---|
| 2005/0140595 | A1* | 6/2005 | Yang | G09G 3/30 345/76 |
| 2011/0291919 | A1 | 12/2011 | Kerofsky et al. | |
| 2018/0211605 | A1* | 7/2018 | Kim | G09G 3/3275 |

FOREIGN PATENT DOCUMENTS

| | | | |
|---|---|---|---|
| CN | 101006487 | A | 7/2007 |
| CN | 101019163 | A | 8/2007 |
| CN | 102640208 | A | 8/2012 |
| CN | 106710509 | A | 5/2017 |

* cited by examiner

DRIVING SYSTEM OF DISPLAY PANEL AND DISPLAY DEVICE USING THE SAME

RELATED APPLICATIONS

This application is a continuation in part of PCT Application Serial Number PCT/CN2018/096547 filed Jul. 21, 2018 that in turn claims priority of Chinese Application Number 201810747839.X filed Jul. 10, 2018; the contents of which are hereby incorporated by reference.

TECHNICAL FIELD

The present disclosure relates to the field of display technologies, and in particular, to a driving system for a display panel and a display device using the same.

BACKGROUND

With increasing resolutions of display products such as mobile phones and televisions, driving chips with higher resolutions are required so as to drive pixel circuits, and grayscales to be displayed need to be finer. As a result, more and more wires are fed to a source driving operational amplifier. Besides, now for achieving a better display effect, an initial image data will be converted from 8 bits to 10 bits, which will increase difficulty of implementing a conventional source configuration. Moreover, grayscale voltages for RGB three colors are within different ranges. In order to achieve a better display effect, it is necessary to generate an independent gamma curve for sub-pixels of each color.

In a conventional analog source gamma implementation method, for image data of 10 bits, the lower 4 bits are used for interpolation control of a source operational amplifier, and the higher 6 bits are used as a selection control signal of a digital-to-analog conversion circuit. Two adjacent voltages are selected from 65 grayscale voltages and then sent to the source operational amplifier for interpolation to generate 16 voltages. In this way, 64*16=1024 grayscales can be generated. Therefore, 65 voltage wire channels are required in the source operational amplifier. If this method is adopted to achieve an independent gamma curve of RGB, 65*3=195 voltage wire channels are required in the source operational amplifier, which will occupy a very large area, besides, a digital-to-analog converter of 6 bits needs to be made before the source operational amplifier to select two adjacent voltages from 65 voltages. The digital-to-analog converter of 6 bits also requires a large area.

In a conventional ramp source gamma implementation method: for image data of 10 bits, the lower 4 bits are used for interpolation control of the source operational amplifier; a set of 10 bits continuous jumping digital signals B<9:0> is used as control signals for generating ramp voltages, and two sets of ramp voltage curves are generated, and this set of 10-bit digital signals B<9:0> is compared with a higher 10-bit image data A<9:0>, when they are identical, a set of ramp step voltage values corresponding to the 10-bit digital signal B<9:0> at this time is sent to the source operational amplifier, so only one voltage wire channel is required in the source operational amplifier; if this method is adopted to achieve an independent gamma curve of RGB, 3 voltage wire channels are required in the source amplifier; but at this time, the duration for generating each grayscale voltage is only equal to (display duration for 1 row of sub-pixels)/1024. When the resolution is high, this duration is in an order of nanoseconds, which is very difficult to be achieved.

In the conventional digital gamma implementation method, in order to achieve the independent gamma curve of RGB, the image data of 10 bits is extended to 12 bits to implement a dithing function. However, this requires digital circuits to perform higher-speed signal processing, which will cause an exponential increase in power consumption of the digital circuit.

SUMMARY

The object of the present disclosure is to provide a driving system for a display panel and a display device using the same, which can solve the problems of the conventional analog source gamma occupying a very large area, the conventional ramp source gamma implementation method having high requirements on time, and the conventional digital gamma having very high power consumption.

In order to solve the technical problems described above, the technical solutions provided by the embodiments of the present disclosure are as follows.

In an aspect, a driving system for a display panel is provided, and the display panel includes a pixel circuit including a plurality of columns of data signal input terminals, and the driving system includes:

a voltage generating circuit configured to generate $(2^{m+k}+1)$ initial grayscale voltages;

a ramp voltage curve generating circuit configured to generate $(2^m+1)$ ramp voltage curves by using the $(2^{m+k}+1)$ initial grayscale voltages based on k-bit data of received pixel data, wherein each ramp voltage curve of the $(2^m+1)$ ramp voltage curves includes $2^k$ step voltages;

a source driving circuit configured to generate additional $2^n$ ramp voltage curves by using any two adjacent ramp voltage curves of the $(2^m+1)$ ramp voltage curves based on m-bit data of the received pixel data; and an output control circuit configured to select a grayscale voltage of the ramp voltage curves based on the received pixel data and send the selected grayscale voltage to the data signal input terminals of the pixel circuit.

Further, the display panel includes:

a buffer configured to buffer the $(2^m+1)$ ramp voltage curves and to output $(2^m+1)$ buffer ramp voltage curves;

the source driving circuit is specifically configured to select any two adjacent buffer ramp voltage curves from the $(2^m+1)$ buffer ramp voltage curves based on the m-bit data of the received pixel data, and to perform interpolation and voltage dividing on the selected two buffer ramp voltage curves based on n-bit data of the received pixel data to generate additional $2^n$ ramp voltage curves.

Further, the ramp voltage curve generating circuit is specifically configured to form a first ramp voltage curve by using $1^{st}$, $(1+2^k)^{th}$, . . . , $(1+2^k*(2^m-1))^{th}$ initial grayscale voltages; to form a second ramp voltage curve by using $2^{nd}$, $(2+2^k)^{th}$, . . . , $(2+2^k*(2^m-1))^{th}$ initial grayscale voltages; . . . ; and to form a $(2^m+1)^{th}$ ramp voltage curve by using $(2^m+1)^{th}$, $(2^m+1+2^k)^{th}$, . . . , $(2^m+1+2^k*(2^m-1))^{th}$ gray scale voltages.

Further, the source driving circuit includes:

a multiplexer configured to select an $(x+1)^{th}$ buffer ramp voltage curve and an $(x+2)^{th}$ buffer ramp voltage curve when a decimal number corresponding to the m-bit data is x.

Further, the source driving circuit further includes:

an interpolation voltage dividing circuit configured to generate a grayscale voltage $(y*OUT_H+(2^n-y)*OUT_L)/2^n$ when a decimal number corresponding to the n-bit data is y, where OUT_H is the $(x+2)^{th}$ buffer ramp voltage curve, and OUT_L is the $(x+1)^{th}$ buffer ramp voltage curve.

Further, the output control circuit includes:

a comparator configured to compare a k-bit data of the pixel data in one column of data signal input terminals of the plurality of columns of data signal input terminals with a value of a digital register that is jumping; and a controller configured to send a grayscale voltage corresponding to (m+n)-bit data of the pixel data to the data signal input terminals when the k-bit data is identical to the value of the digital register.

Further, the pixel data includes (k+m+n)-bit data.

Further, the k-bit data is first k-bit data, the m-bit data is middle m-bit data, and the n-bit data is last n-bit data.

Further, the k-bit data is middle k-bit of data, the m-bit data is first m-bit data, and the n-bit data is last n-bit data.

Further, k=3, m=3, and n=4.

An embodiment of the present disclosure further provides a display device, including a display panel and the driving system for the display panel described above.

Further, the display panel is an OLED display panel or a liquid crystal display panel.

Further, RGB gamma voltage curves of the display device are independent from each other.

Embodiments of the present disclosure have following beneficial effects.

For the scheme described above, the pixel data is a (k+m+n)-bit data, in which k-bit data is configured to generate $2^k$ step voltages, m-bit data is configured to select any two adjacent buffer ramp voltage curves, and n-bit data is configured as an interpolation control signal to perform interpolation and voltage dividing on the selected two adjacent buffer ramp voltage curves to generate additional $2^n$ ramp voltage curves. In this way, there are $(2^m+1)$ voltage wire channels in the source operational amplifier, which is much smaller than that of the conventional source gamma configuration, thereby solving the problem of a large area occupied by the conventional analog source gamma implementation method. Moreover, the time occupied by each step voltage is (display time for 1 row of sub-pixels)/$2^k$, which is much longer than the time occupied by each step voltage in the conventional ramp source gamma configuration, thereby solving the problem of high time requirements of the conventional ramp source gamma implementation method. In addition, the driving system of the present disclosure can achieve RGB independent gamma, so there is no need for additional bits to achieve untrue RGB independent gamma, thereby reducing the bits and power consumption of the overall chip and solving the problem of very high power consumption of the conventional digital gamma implementation method.

DESCRIPTION OF EMBODIMENTS

In order to make the technical problems to be solved, technical solutions, and advantages of the present disclosure clearer, details will be described in the following with reference to the accompanying drawings and the embodiments.

Figure 1:
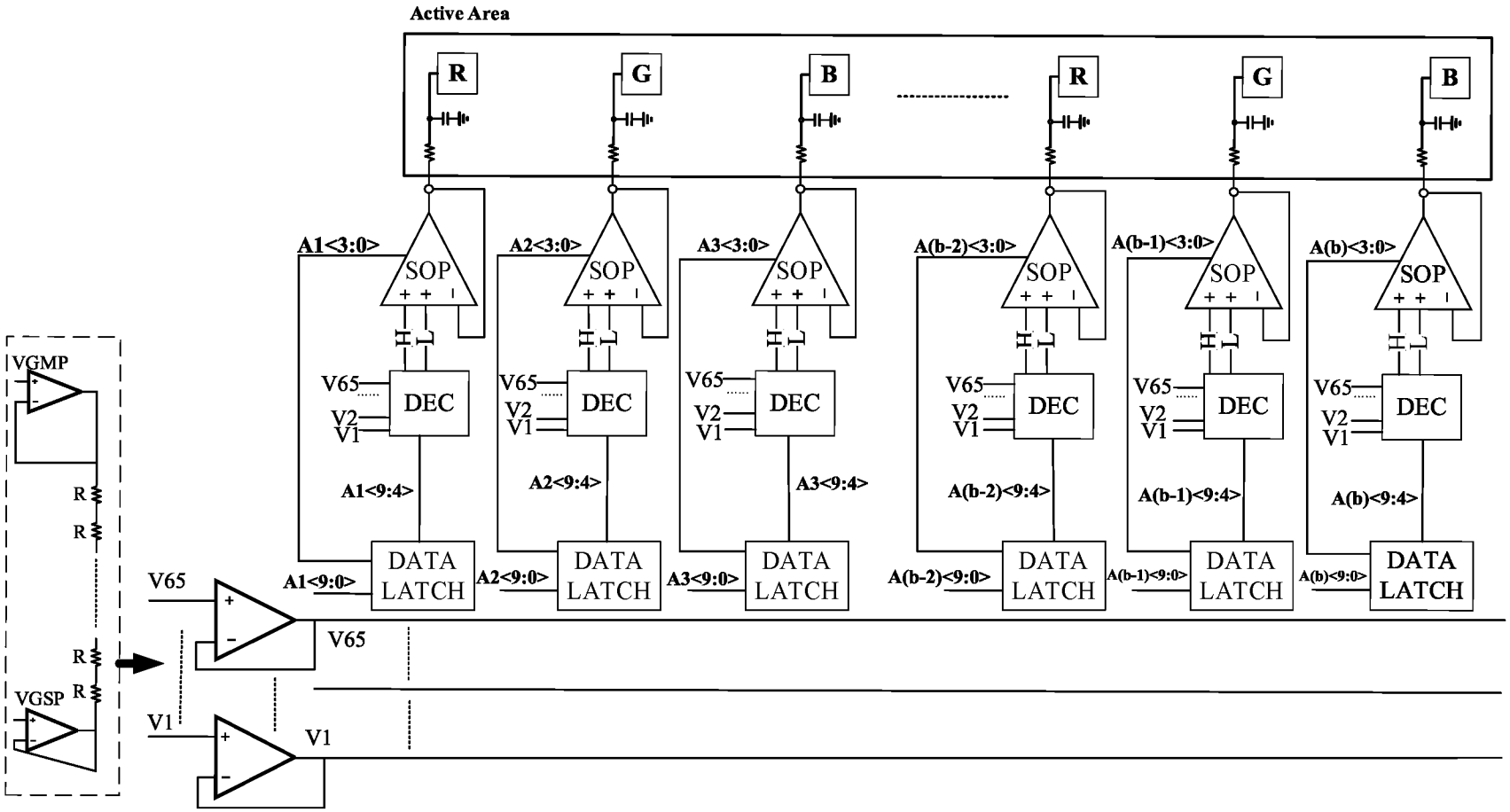
FIG. 1 is a schematic diagram of an analog source gamma circuit in the prior art.

As shown in FIG. 1, in a conventional analog source gamma implementation method: for image data of 10 bits, the lower 4 bits are used for interpolation control of a source operational amplifier; and the higher 6 bits are used as a selection control signal for a digital-to-analog conversion circuit. Two adjacent voltages are selected from 65 grayscale voltages (V1-V65) and then sent to the source operational amplifier for interpolation to generate 16 voltages. In this way, 64*16=1024 grayscales can be generated. Therefore, 65 voltage wire channels are required in the source operational amplifier. If this method is adopted to achieve an independent gamma curve of RGB, 65*3=195 voltage wire channels are required in the source operational amplifier, which will occupy a very large area, besides, a digital-to-analog converter of 6 bits needs to be made before the source operational amplifier to select two adjacent voltages from the 65 voltages. The digital-to-analog converter of 6 bits also requires a large area.

Figure 2:
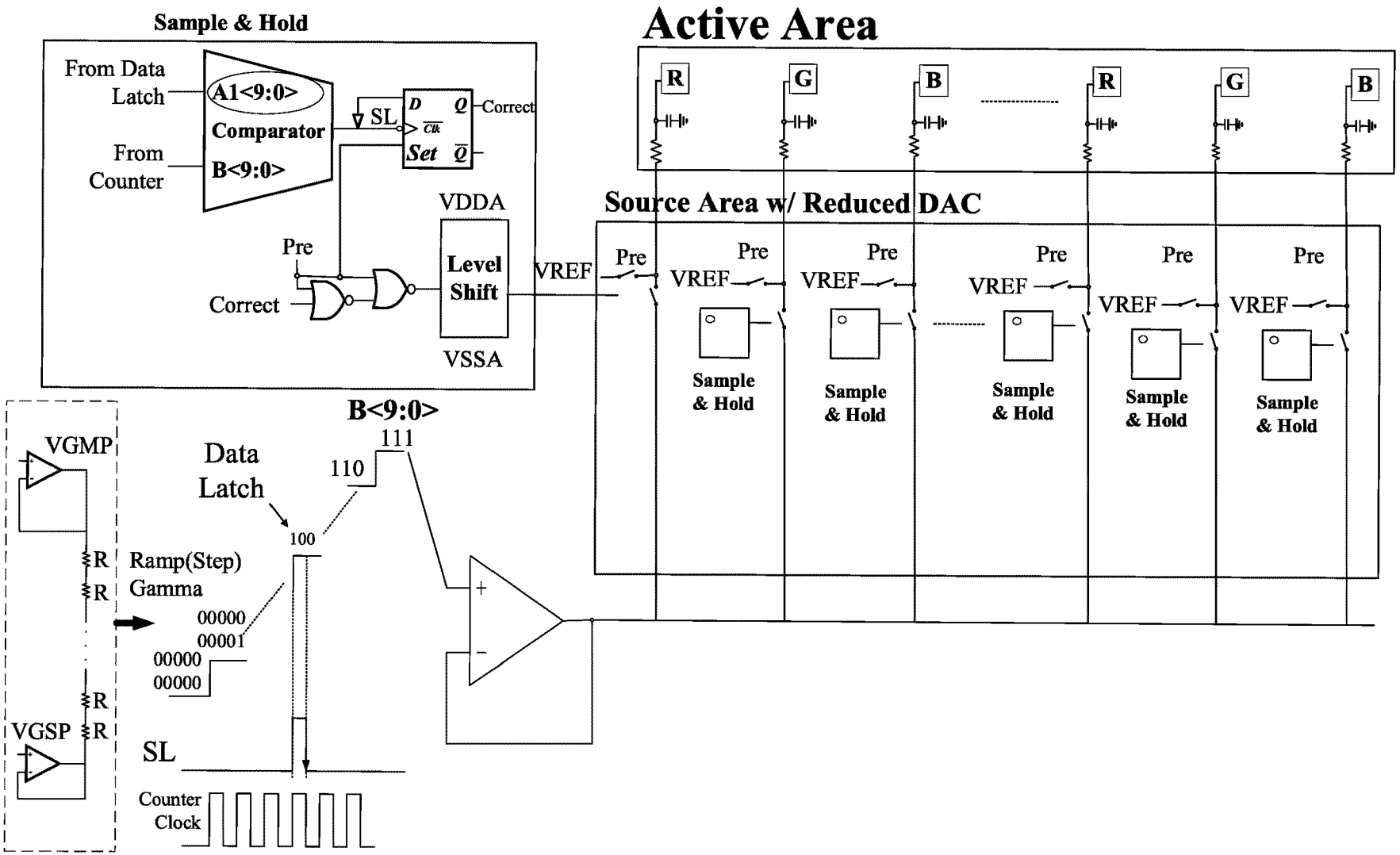
FIG. 2 is a schematic diagram of a ramp source gamma circuit in the prior art.

As shown in FIG. 2, in a conventional ramp source gamma implementation method: for image data of 10 bits, the lower 4 bits are used for interpolation control of the source operational amplifier; a set of 10 bits continuous jumping digital signals B<9:0> is used as control signals for generating ramp voltages, and two sets of ramp voltage curves are generated, and this set of 10-bit digital signals B<9:0> is compared with a higher 10-bit image data A<9:0>, when they are identical, a set of ramp step voltage values corresponding to the 10-bit digital signal B<9:0> at this time is sent to the source operational amplifier, so only one voltage wire channel is required in the source operational amplifier; if this method is adopted to achieve an independent gamma curve of RGB, 3 voltage wire channels are required in the source amplifier; but at this time, the duration for generating each grayscale voltage is only equal to (display duration for 1 row of sub-pixels)/1024. When the resolution is high, this duration is in an order of nanoseconds, which is very difficult to achieve.

In the conventional digital gamma implementation method, in order to achieve the independent gamma curve of RGB, the image data of 10 bits is extended to 12 bits to implement a dithing function. However, this requires digital circuits to perform higher-speed signal processing, which will cause an exponential increase in power consumption of the digital circuit.

Embodiments of the present disclosure are directed to the problems of the conventional analog source gamma occupying a very large area, the conventional ramp source gamma implementation method having very short time requirements, and the conventional digital gamma having very high power consumption in implementing independent RGB gamma curves, and thus a driving system for a display panel and a display device using the same are provided, which can solve the problems that the conventional analog source gamma implementation method occupies a large area, the conventional ramp source gamma implementation method has a high time requirement, and the conventional digital gamma implementation method has a very high power consumption.

Figure 3:
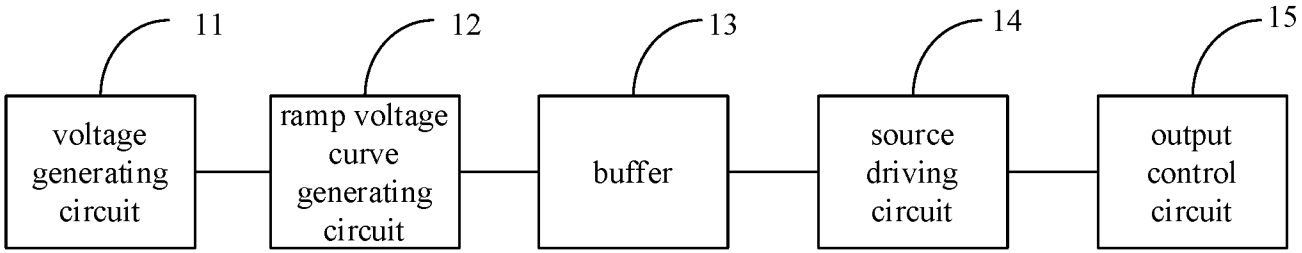
FIG. 3 is a structural schematic diagram of a driving system for a display panel according to an embodiment of the present disclosure.

An embodiment of the present disclosure provides a driving system for a display panel. The display panel includes a pixel circuit. The pixel circuit includes a plurality of columns of data signal input terminals. As shown in FIG. 3, the driving system includes:

a voltage generating circuit 11, configured to generate $2^{m+k}+1$ initial grayscale voltages;

a ramp voltage curve generating circuit 12, configured to generate $2^m+1$ ramp voltage curves using the $2^{m+k}+1$ initial grayscale voltage based on k-bit data of the received pixel data, each ramp voltage curve including $2^k$ step voltages.

a source driving circuit 14, configured to generate additional $2^n$ ramp voltage curves using any two adjacent ramp voltage curves of the $2^m+1$ ramp voltage curves based on m-bit data of the received pixel data; and an output control circuit 15, configured to send a grayscale voltage in the ramp voltage curves to a data signal input terminal of the pixel circuit based on the received pixel data. In this embodiment, the pixel data is divided into three parts of (k+m+n), k-bit data is configured to generate $2^k$ step voltages, m-bit data is configured to select any two adjacent buffer ramp voltage curves, and n-bit data is configured as an interpolation control signal to perform interpolation and voltage dividing on the selected two buffered ramp voltage curves to generate additional $2^n$ ramp voltage curves. In this way, there are $2^m+1$ wire channels in the source operational amplifier, which is much smaller than a conventional source gamma configuration, thereby solving the problem of a large area occupied by the conventional analog source gamma implementation method. Moreover, the time occupied by each step voltage is (display time for 1 row of sub-pixels)/$2^k$, which is much longer than the time occupied by each step voltage in the conventional ramp source gamma configuration, thereby solving the problem of high time requirements of the conventional ramp source gamma implementation method. In addition, the driving system of the present disclosure can achieve RGB independent gamma, so there is no need for additional bits to achieve pseudo RGB independent gamma, thereby reducing the bits and power consumption of the overall chip and solving the problem of very high power consumption of the conventional digital gamma implementation method.

Further, as shown in FIG. 3, the driving system further includes:

a buffer 13, configured to buffer the $2^m+1$ ramp voltage curves to output $(2^m+1)$ buffer ramp voltage curves; and a source driving circuit 14, configured to select any two adjacent buffer ramp voltage curves from the $2^m+1$ buffer ramp voltage curves based on m-bit data of the received pixel data, and perform interpolation and voltage dividing on the selected two buffer ramp voltage curves based on n-bit data of the received pixel data to generate additional $2^n$ ramp voltage curves.

Further, the ramp voltage curve generating circuit 12 is configured to use $1^{st}$, $(1+2^k)^{th}$, . . . , $(1+2^k*(2^m-1))^{th}$ initial grayscale voltages to form a first ramp voltage curve and use $2^{nd}$, $(2+2^k)^{th}$, . . . , $(2+2^k*(2^m-1))^{th}$ initial grayscale voltages to form a second ramp voltage curve; . . . ; and use $(2^m+1)^{th}$, . . . , $(2^m+1+2^k)^{th}$, . . . , $(2^m+1+2^k*(2^m-1))^{th}$ gray scale voltages to form a $(2^m+1)^{th}$ ramp voltage curve.

Figure 4:
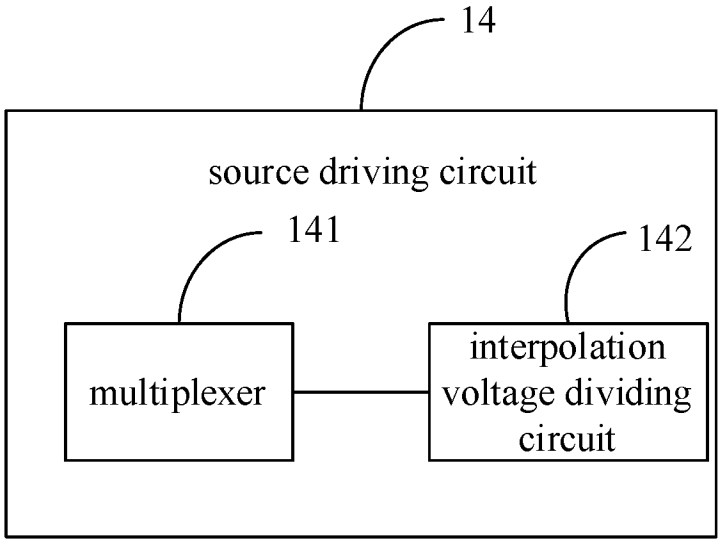
FIG. 4 is a structural schematic diagram of a source driving circuit according to an embodiment of the present disclosure.

Further, as shown in FIG. 4, the source driving circuit 14 includes:

a multiplexer 141, configured to select $(x+1)^{th}$ and $(x+2)^{th}$ buffer ramp voltage curves when a decimal number corresponding to the m-bit data is x.

Further, as shown in FIG. 4, the source driving circuit 14 further includes:

an interpolation voltage dividing circuit 142, configured to generate a grayscale voltage $(y*OUT_H+(2^n-y)*OUT_L)/2^n$ when the decimal number corresponding to the n-bit data is y, where OUT_H is the $(x+2)^{th}$ buffer ramp voltage curve, and OUT_L is the $(x+1)^{th}$ buffer ramp voltage curve.

Figure 5:
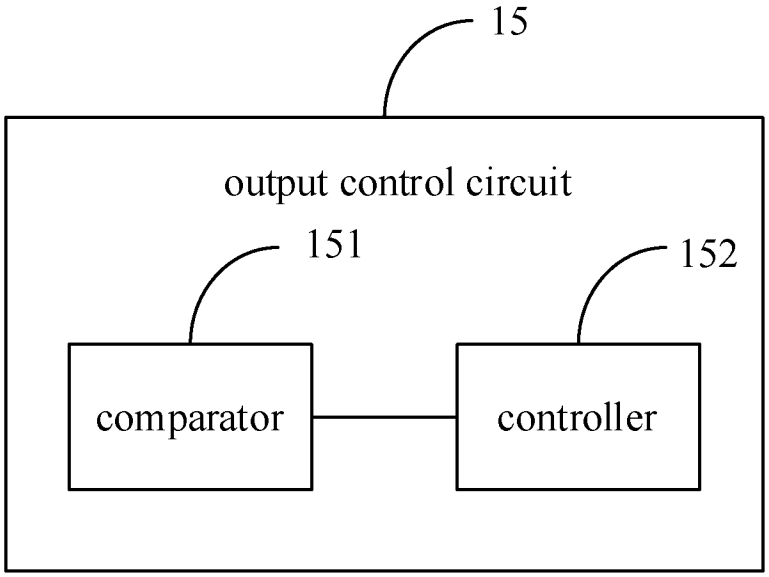
FIG. 5 is a structural schematic diagram of an output control circuit according to an embodiment of the present disclosure.

Further, as shown in FIG. 5, the output control circuit 15 includes:

a comparator 151, configured to compare a k-bit data of the pixel data in one column of data signal input terminals with a value of a digital register that is jumping, and a controller 152, configured to send a grayscale voltage corresponding to (m+n)-bit data of the pixel data to the data signal input terminal when the k-bit data is the same as the value of the digital register.

Preferably, the pixel data includes (k+m+n)-bit data, that is, the pixel data has no extra data except for the necessary (k+m+n)-bit data. In this way, the number of bits of the pixel data can be reduced, thereby reducing a transmission amount of pixel data.

Here, positions of the k-bit data, the m-bit data, and the n-bit data of the pixel data are not limited, which can be designed according to actual needs. In an embodiment, the k-bit data may be first k-bit data of the pixel data, the m-bit data may be middle m-bit data of the pixel data, and the n-bit data may be last n-bit data of the pixel data. In another embodiment, the k-bit data may be middle k-bit data of the pixel data, the m-bit data may be first m-bit data of the pixel data, and the n-bit data may be last n-bit data of the pixel data.

It is appreciated that, the positions of the k-bit data, the m-bit data, and the n-bit data of the pixel data are not limited to the positions in the above two embodiments. For example, the k-bit data may be last k-bit data of the pixel data, the m-bit data may be middle m-bit data of the pixel data, the n-bit data may be first n-bit data of the pixel data, and so on.

When the pixel data includes 10-bit data, k may be 3, m may be 3, and n may be 4, and of course other values can also be adopted according to actual needs.

The driving system for the display panel according to the present disclosure will be further described in the following with reference to the accompanying drawings and embodiments.

Embodiment One

In this embodiment, a configuration of a hybrid source gamma is provided, in which the pixel data is a 10-bit (k+m+n) data signal, and the first 3(k)-bit data is configured to generate $2^k$ step voltages, the middle 3(m)-bit data is configured to select any two adjacent buffer ramp voltage curves from the $2^m+1$ buffer ramp voltage curves, and the last 4(n)-bit data is configured to perform interpolation and voltage dividing on the selected two buffer ramp voltage curves to generate additional $2^n$ ramp voltage curves. In this way, there are $2^m+1$ wire channels in the source operational amplifier, and the time occupied by each step voltage is (1 row)/$2^k$.

Figure 6:
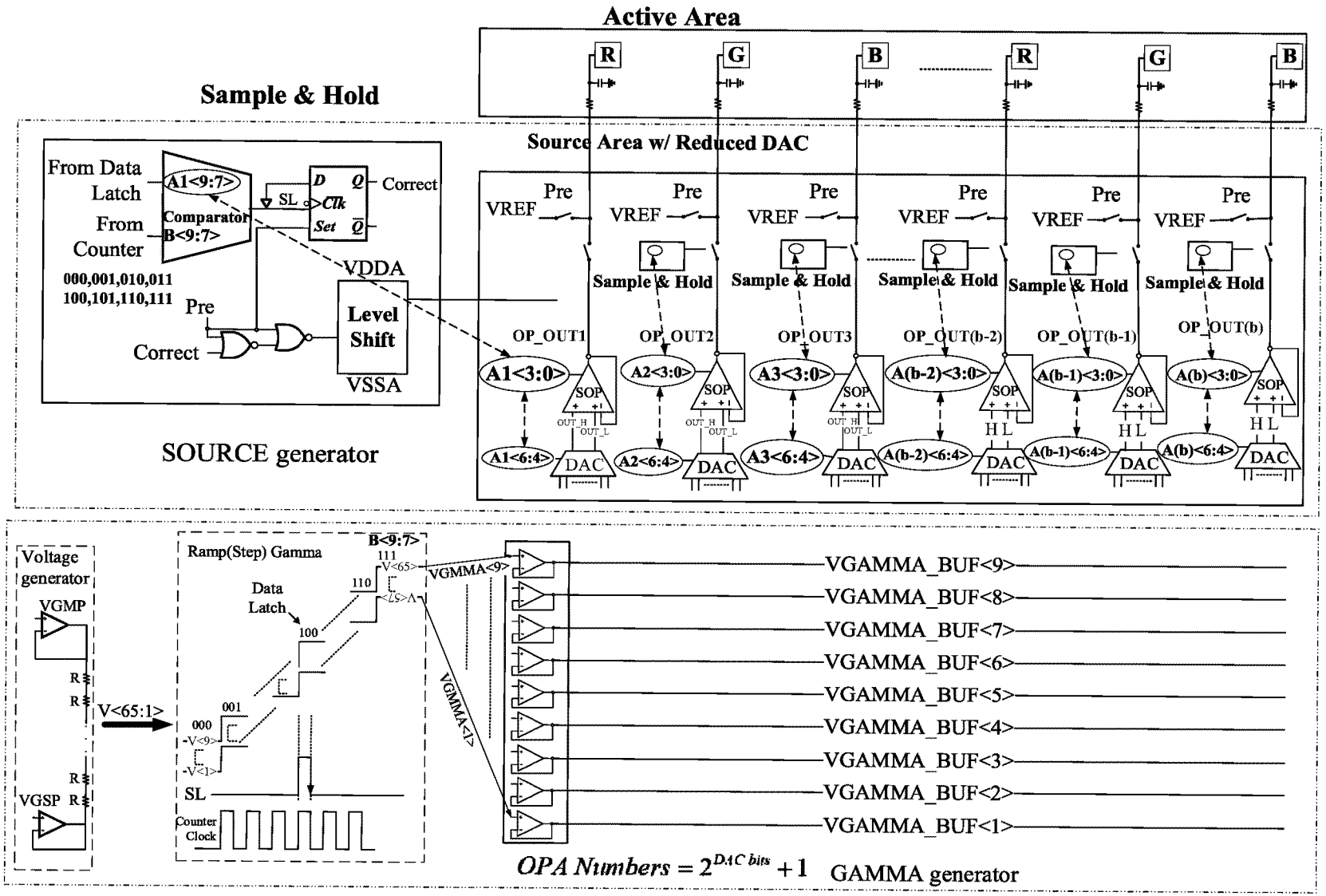
FIGS. 6, 6A, 6B, and 6C are schematic circuit diagrams of a driving system for a display panel according to an embodiment of the present disclosure.
Figure 6A:
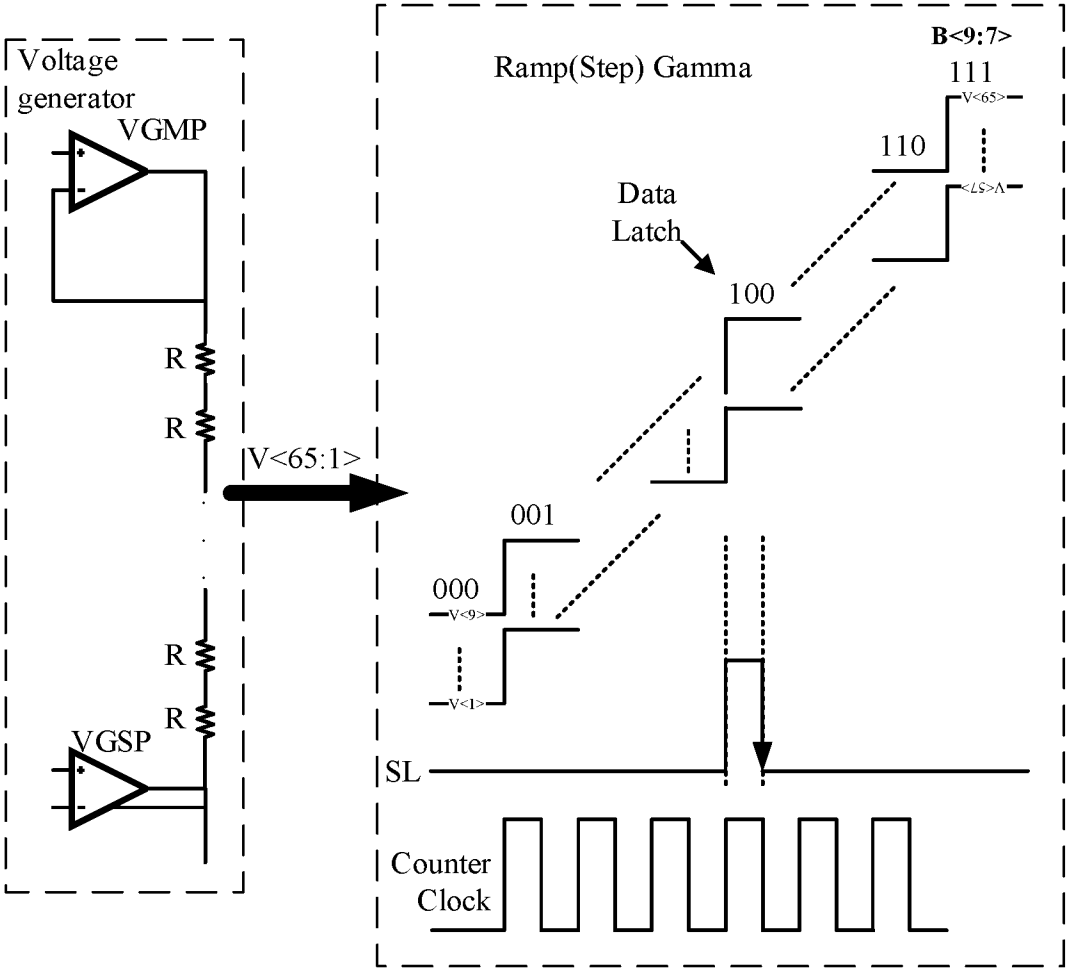
Figure 6B:
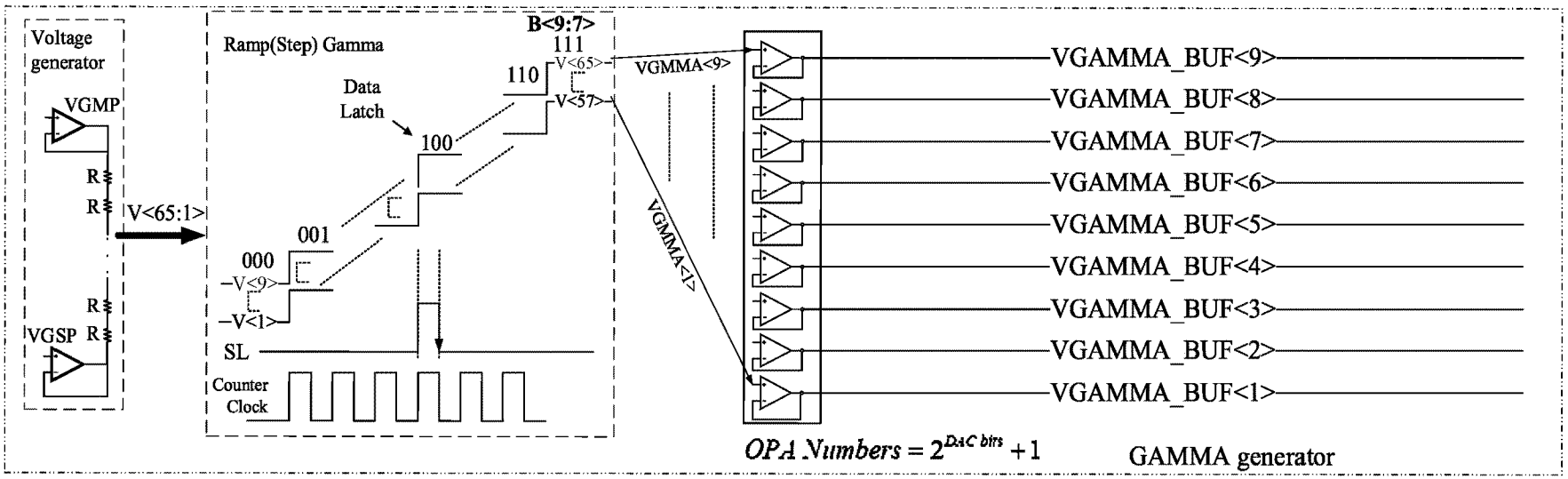

As shown in FIG. 6, a lower half part of the figure illustrates a gamma voltage generating circuit and an enlarged schematic diagram of the gamma voltage generating circuit is shown in FIG. 6B; a lower left part illustrates a voltage generating circuit (voltage generator) and an enlarged schematic diagram of the voltage generating circuit is shown in FIG. 6A, which is configured to generate 65 initial grayscale voltages (V1-V65), where $65=2^{k+m}+1$. Then, through a Counter Clock and a multiplexer (SL), the 65 initial grayscale voltages are configured to generate $(2^3+1)$ ramp voltage curves, from VGAMMA<1> to VGAMMA<9>.

The specific implementation method for generating the ramp voltage curve is as follows: at the very beginning, the value of the digital register B<9:7> is set to 000, and at a rising edge of Counter Clock, the value of digital register B<9:7> becomes 001, and at a next rising edge of Counter Clock, the value of digital register B<9:7> becomes 010, and so on, until the value of the digital register B<9:7> becomes 111, and at a next rising edge of Counter Clock, the value of the digital register B<9:7> is reset to 000, and a cycle is implemented in this way. The specific voltage selected by VGAMMA<9:1> is shown in Table 1.

TABLE 1

| | B<9:7> | | | | | | | |
|---|---|---|---|---|---|---|---|---|
| | 000 | 001 | 010 | 011 | 100 | 101 | 110 | 111 |
| VGAMMA<9> | V<9> | V<17> | V<25> | V<33> | V<41> | V<49> | V<57> | V<65> |
| VGAMMA<8> | V<8> | V<16> | V<24> | V<32> | V<40> | V<48> | V<56> | V<64> |
| VGAMMA<7> | V<7> | V<15> | V<23> | V<31> | V<39> | V<47> | V<55> | V<63> |
| VGAMMA<6> | V<6> | V<14> | V<22> | V<30> | V<38> | V<46> | V<54> | V<62> |
| VGAMMA<5> | V<5> | V<13> | V<21> | V<29> | V<37> | V<45> | V<53> | V<61> |
| VGAMMA<4> | V<4> | V<12> | V<20> | V<28> | V<36> | V<44> | V<52> | V<60> |
| VGAMMA<3> | V<3> | V<11> | V<19> | V<27> | V<35> | V<43> | V<51> | V<59> |
| VGAMMA<2> | V<2> | V<10> | V<18> | V<26> | V<34> | V<42> | V<50> | V<58> |
| VGAMMA<1> | V<1> | V<9> | V<17> | V<25> | V<33> | V<41> | V<49> | V<57> |

It can be seen that each ramp voltage curve includes $2^k$ initial grayscale voltages. For example, VGAMMA<1> includes V<1>, V<9>, V<17>, V<25>, V<33>, V<41>, V<49> and V<57>; VGAMMA<2> includes V<2>, V<10>, V<18>, V<26>, V<34>, V<42>, V<50> and V<58>; . . . ; VGAMMA<9> includes V<9>, V<17>, V<25>, V<33>, V<41>, V<49>, V<57>, and V<65>.

Then, the 9 ramp voltage curves generated above generate, through the buffer, 9 buffer ramp voltage curves VGAMMA_BUF<1>-VGAMMA_BUF<9>, which are sent to the source operational amplifier, which is shown in an upper half of FIG. 6.

Figure 6C:
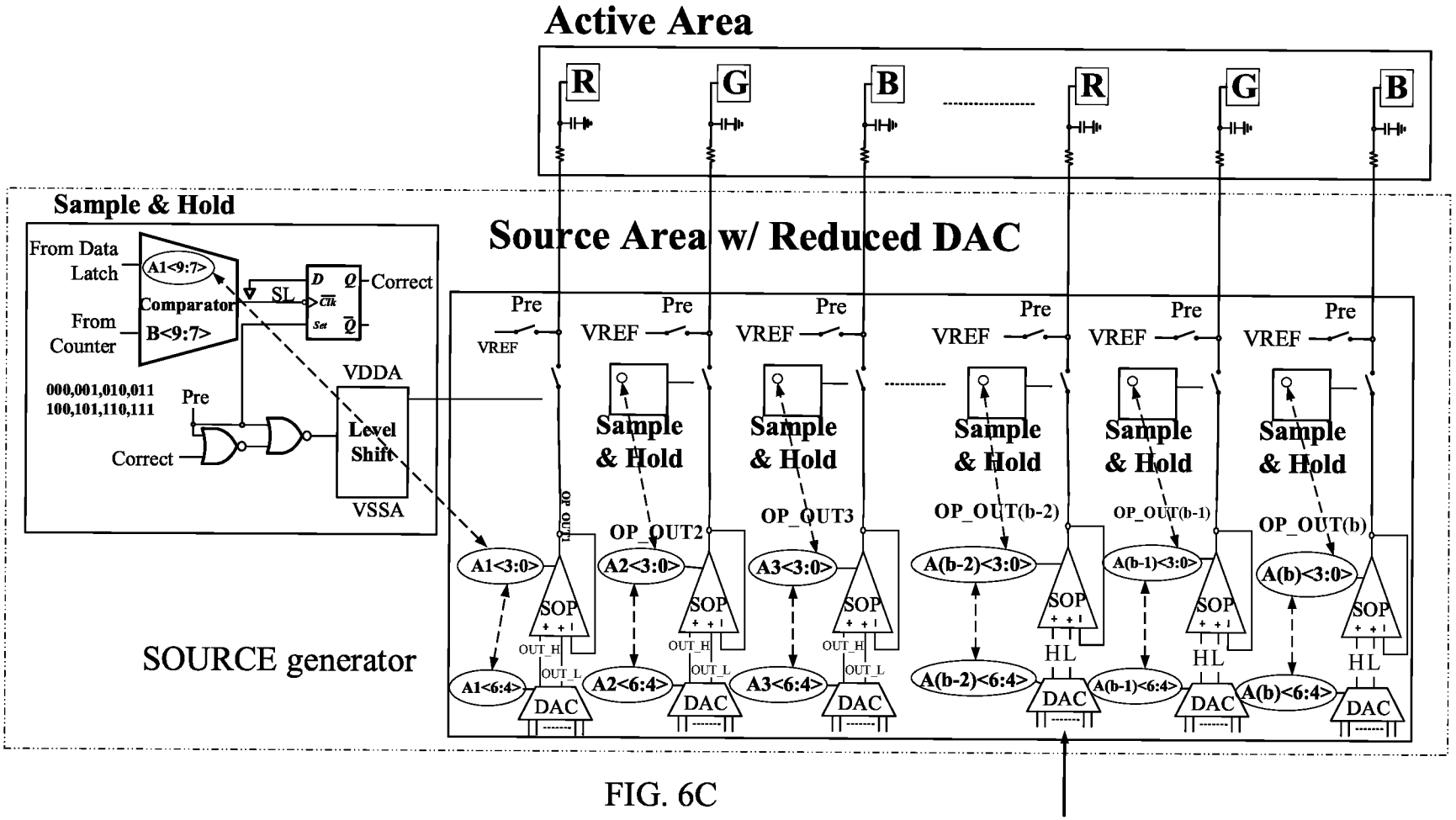

The upper half of FIG. 6 is a source driving part, and an enlarged schematic diagram of the source driving part is shown in FIG. 6C, which mainly includes a multiplexer, an interpolation driving operational amplifier, and a digital comparator. Take the source driving circuit in a first column as an example: middle 3-bit data of the pixel data corresponding to the data signal input terminal of the pixel circuit in a first column, that is, a $4^{th}$-$6^{th}$-bit dada A1<6:4> in A1 is configured as a control signal to select adjacent two VGAMMA_BUF voltages as OUT_H and OUT_L; the selected VGAMMA_BUF voltage is shown in Table 2.

TABLE 2

| | | | | |
|---|---|---|---|---|
| A1<6:4> | 000 | 001 | 010 | 011 |
| OUT_H | VGAMMA_BUF<2> | VGAMMA_BUF<3> | VGAMMA_BUF<4> | VGAMMA_BUF<5> |
| OUT_L | VGAMMA_BUF<1> | VGAMMA_BUF<2> | VGAMMA_BUF<3> | VGAMMA_BUF<4> |
| A1<6:4> | 100 | 101 | 110 | 111 |
| OUT_H | VGAMMA_BUF<6> | VGAMMA_BUF<7> | VGAMMA_BUF<8> | VGAMMA_BUF<9> |
| OUT_L | VGAMMA_BUF<5> | VGAMMA_BUF<6> | VGAMMA_BUF<7> | VGAMMA_BUF<8> |

The last 4-bit data of the pixel data inputted from an input terminal of the first column of data signals, that is, the $0^{th}$-$3^{rd}$-bit data A1<3:0> in A1 is configured as a control signal of the interpolation driving operational amplifier to generate 16 grayscale voltages between OUT_H and OUT_L voltages, and the generated gray voltages are shown in Table 3.

TABLE 3

| | | |
|---|---|---|
| A1<3:0> | 0000 | 0001 |
| OP_OUT | OUT_L | (OUT_H + 15*OUT_L)/16 |
| A1<3:0> | 0010 | 0011 |
| OP_OUT | (2*OUT_H + 14*OUT_L)/16 | (3*OUT_H + 13*OUT_L)/16 |
| A1<3:0> | 0100 | 0101 |
| OP_OUT | (4*OUT_H + 12*OUT_L)/16 | (5*OUT_H + 11*OUT_L)/16 |
| A1<3:0> | 0110 | 0111 |
| OP_OUT | (6*OUT_H + 10*OUT_L)/16 | (7*OUT_H + 9*OUT_L)/16 |
| A1<3:0> | 1000 | 1001 |
| OP_OUT | (8*OUT_H + 8*OUT_L)/16 | (9*OUT_H + 7*OUT_L)/16 |
| A1<3:0> | 1010 | 1011 |
| OP_OUT | (10*OUT_H + 6*OUT_L)/16 | (11*OUT_H + 5*OUT_L)/16 |
| A1<3:0> | 1100 | 1101 |
| OP_OUT | (12*OUT_H + 4*OUT_L)/16 | (13*OUT_H + 3*OUT_L)/16 |
| A1<3:0> | 1110 | 1111 |
| OP_OUT | (14*OUT_H + 2*OUT_L)/16 | (15*OUT_H + 1*OUT_L)/16 |

In this way, the last 7-bit data of the pixel data, that is, the lower 7-bit data A1<6:0> determines an only one set of step voltages, and then a comparison result of A1<9:7> and B<9:7> controls, through a level conversion circuit, whether a switch connected to an output of the source operational amplifier and a data signal input terminal of the first column of pixel circuits is turned off. A1<9:7> is first 3-bit data of the pixel data corresponding to the data signal input terminal of the first column of pixel circuits, that is, the $7^{th}$-$9^{th}$-bit data of A1, and B<9:7> is a value of a digital register that is constantly jumping.

It is assumed that when A1<9:7> is different from B<9:7>, the comparison result is low, the switch is in an off state, an enable signal of the source operational amplifier is low, and the source operational amplifier is in an inactive state, at this time, B<9:7> jumps from 000 to 111. In this process, when B<9:7> changes to be the same as A1<9:7>, the comparison result becomes high, the switch is turned on, and the enable signal of the source operational amplifier becomes high, the source operational amplifier starts to work and generates a grayscale voltage corresponding to A1<9:0> at this moment, which is then sent to a data signal input terminal of the first column of pixel circuits; when B<9:7> jumps again, A1<9:7> is different from B<9:7>, the comparison result is low and the switch is turned off, at this moment, the gray-scale voltage is maintained by a capacitor in the pixel circuit for display.

As shown in FIG. 6, an active area of the display panel is provided with N columns of pixel circuits. A data signal input terminal of each column of pixel circuits is connected to an output terminal of the source operational amplifier in a one-to-one correspondence. Similar to a process in which the source operational amplifier sends the grayscale voltage to the first column of pixel circuits, the source operational amplifier generates the grayscale voltages corresponding to the first column of pixel circuits to the $N^{th}$ column of pixel circuits, and sends the grayscale voltage to a data signal input terminal for a corresponding pixel circuit at corresponding time.

In a conventional source gamma configuration, $(2^{10-n}+1)$ voltage wires occupy the wire channel of the source operational amplifier and increase an area of the source operational amplifier. A digital-to-analog converter of (10−n) bits and a data latch are also required, thereby significantly increasing the area of the source driving chip; and it is almost impossible to achieve RGB independent gamma. The configuration of hybrid source gamma in this embodiment only needs $(2^{10-k-n}+1)$ voltage wire channels in the source operational amplifier. When k is 3 and n is 4, only 9 voltage wire channels are required, which are much less than that of the conventional source gamma configuration, and the area of the digital-to-analog converter and data latch is saved.

In the conventional ramp source gamma configuration, each ramp has $(2^{10-n})$ step voltages in total. The time occupied by each step voltage is (display time for 1 row of sub-pixels)/$(2^{10-n})$. In this way, the higher the resolution is, the shorter time the step voltage occupies, severely limiting applications of the ramp source gamma. In the hybrid source gamma configuration in this embodiment, each ramp has $2^k$ step voltages in total, and the time occupied by each step voltage is (display time for 1 row of sub-pixels)/$2^k$. When k is 3, the time occupied by each step voltage is (display time for 1 row of sub-pixels)/8, which is much longer than that of the conventional ramp source gamma configuration. Compared with the conventional ramp source gamma configuration, the requirements on time is much lower, which makes it suitable for high-resolution display products.

In the conventional digital gamma implementation method, in order to achieve the independent gamma curve of RGB, the image data of 10 bits is extended to 12 bits to achieve the dithing function. However, this requires digital circuits to perform higher-speed signal processing, which will cause an exponential increase in power consumption of the digital circuit. If the hybrid source gamma configuration in this embodiment is adopted to achieve the RGB independent gamma curve, three sets of gamma generating circuits are required, which are respectively sent to the pixel driving operational amplifier circuit of RGB. In this way, a wire channel with 27 wires is required in the source operational amplifier, which is much smaller than that of the conventional source gamma configuration. Therefore, the hybrid source gamma configuration in this embodiment can be adopted to achieve the RGB independent gamma. In this way, no additional data processing is required for the bits to achieve untrue RGB independent gamma, which reduces digital information processing, thereby reducing the bits and the power consumption of the overall chip.

Embodiment Two

In this embodiment, a configuration of a hybrid source gamma is provided, in which the pixel data is a 10-bit (m+k+n) data signal, in which first 3(m)-bit data is configured to select any two adjacent buffer ramp voltage curves from $2*2^m$ buffer ramp voltage curves; middle 3(k)-bit data is configured to generate $2^k$ step voltages; and last 4(n)-bit data is configured to perform interpolation and voltage dividing on the selected two buffer ramp voltage curves to generate additional $2^n$ ramp voltage curves. In this way, there are $2*2^m$ wire channels in the source operational amplifier, and the time occupied by each step voltage is (1 row)/$2^k$.

Figure 7:
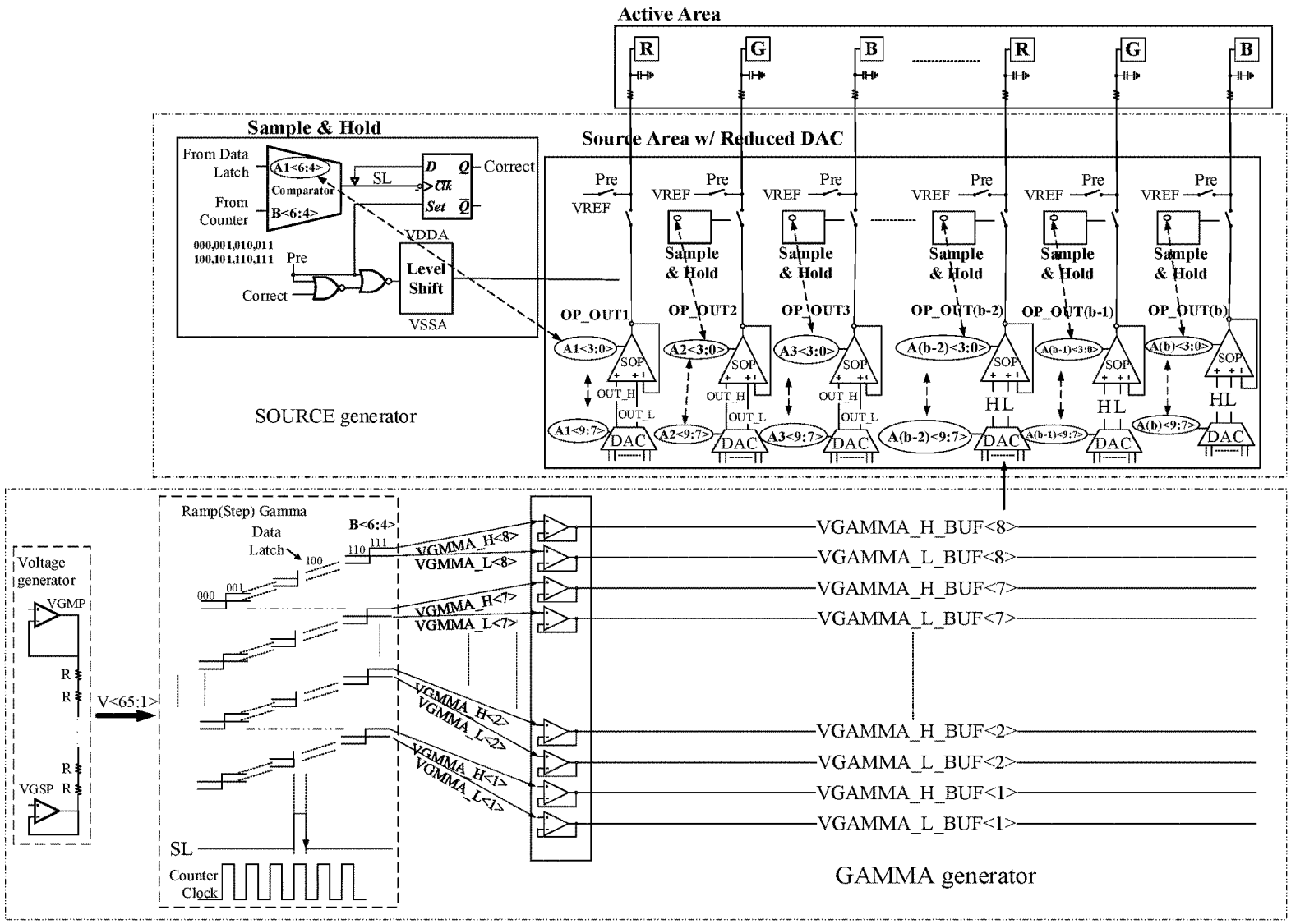
FIGS. 7, 7A, 7B, and 7C are schematic circuit diagrams of a driving system for a display panel according to another embodiment of the present disclosure.
Figure 7A:
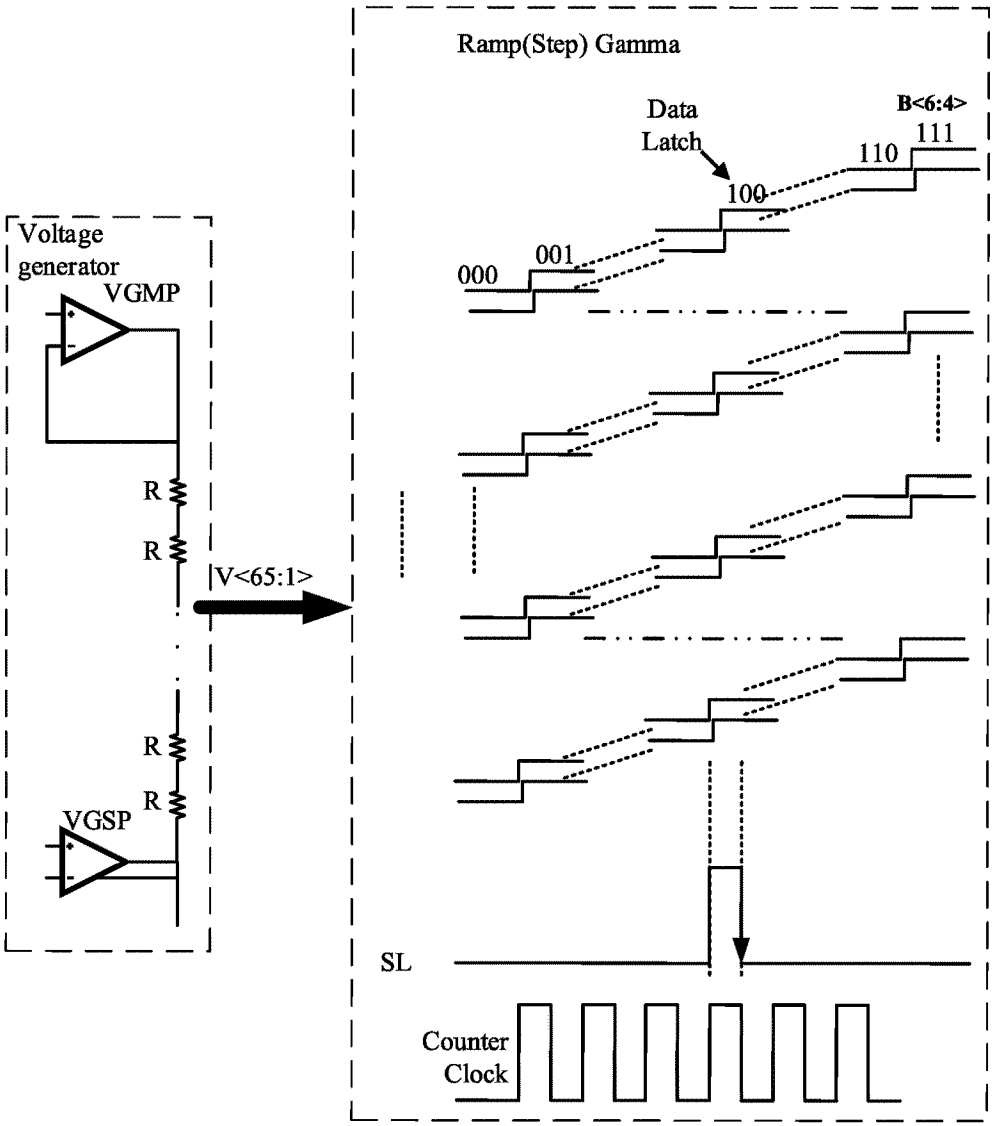
Figure 7B:
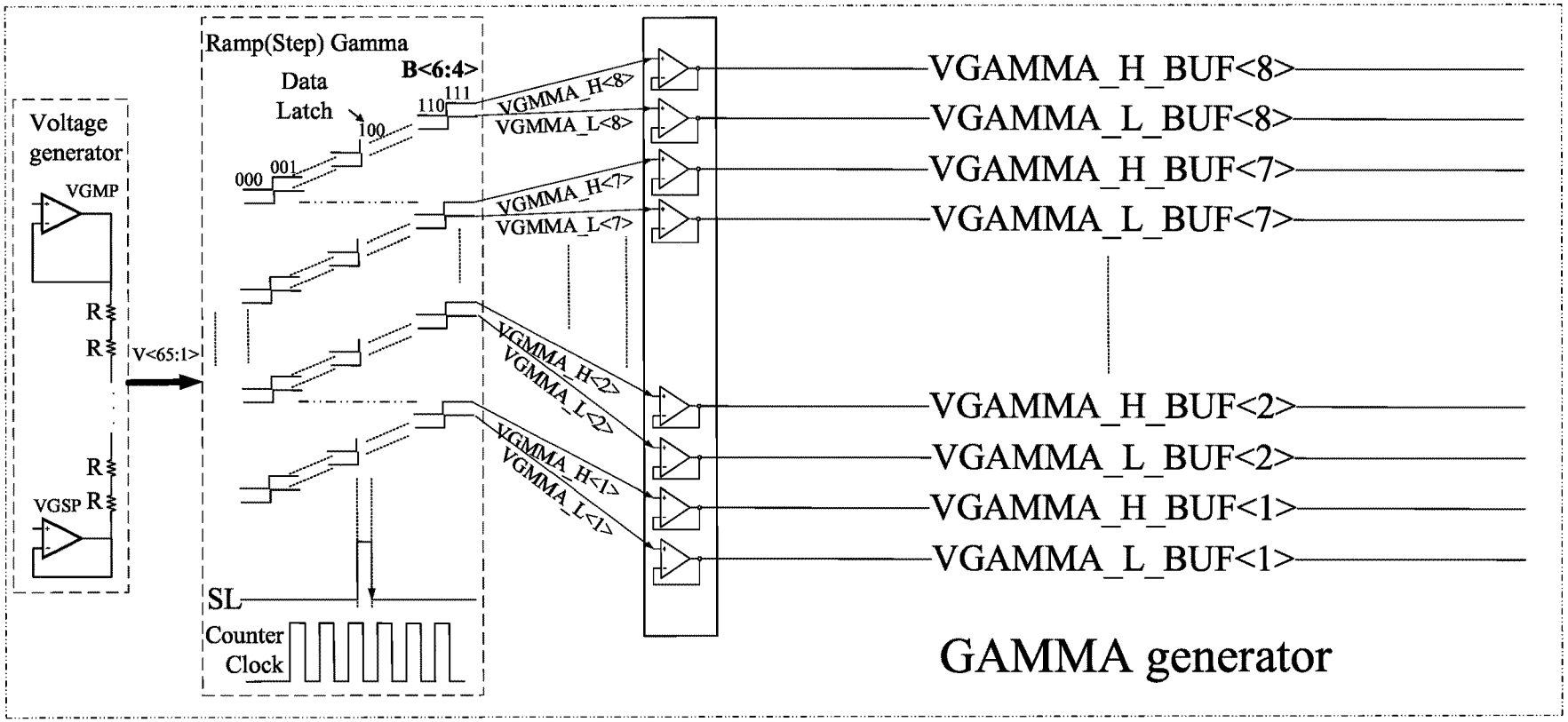

As shown in FIG. 7, a lower half part of the figure illustrates a gamma voltage generating circuit and an enlarged schematic diagram of the gamma voltage generating circuit is shown in FIG. 7B, a lower left part of the figure illustrates a voltage generating circuit (voltage generator) and an enlarged schematic diagram of the voltage generating circuit is shown in FIG. 7A, which is configured to generate 65 initial grayscale voltages (V1-V65), where $65=2^{k+m}+1$. Then, through a Counter Clock and a multiplexer (SL), the 65 initial grayscale voltages are configured to generate $(2*2^m)$ ramp voltage curves, from VGAMMA_H<1>-VGAMMA_H<8>, VGAMMA_L<1>-VGAMMA_L<8>.

The specific implementation method for generating the ramp voltage curve is as follows: at the very beginning, the value of the digital register B<6:4> is set to 000, and at a rising edge of Counter Clock, the value of digital register B<6:4> becomes 001, and at a next rising edge of Counter Clock, the value of digital register B<6:4> becomes 010, and so on, until the value of the digital register B<6:4> becomes 111, and at a next rising edge of Counter Clock, the value of digital register B<6:4> is reset to 000, and a cycle is implemented in this way. The specific voltage selected by VGAMMA_H<8:1> and VGAMMA_L<8:1> is shown in Table 4.

TABLE 4

| | B<6:4> | | | | | | | |
|---|---|---|---|---|---|---|---|---|
| | 000 | 001 | 010 | 011 | 100 | 101 | 110 | 111 |
| VGAMMA_H<8> | V<58> | V<59> | V<60> | V<61> | V<62> | V<63> | V<64> | V<65> |
| VGAMMA_L<8> | V<57> | V<58> | V<59> | V<60> | V<61> | V<62> | V<63> | V<64> |
| VGAMMA_H<7> | V<50> | V<51> | V<52> | V<53> | V<54> | V<55> | V<56> | V<57> |
| VGAMMA_L<7> | V<49> | V<50> | V<51> | V<52> | V<53> | V<54> | V<55> | V<56> |
| VGAMMA_H<6> | V<42> | V<43> | V<44> | V<45> | V<46> | V<47> | V<48> | V<49> |
| VGAMMA_L<6> | V<41> | V<42> | V<43> | V<44> | V<45> | V<46> | V<47> | V<48> |
| VGAMMA_H<5> | V<34> | V<35> | V<36> | V<37> | V<38> | V<39> | V<40> | V<41> |
| VGAMMA_L<5> | V<33> | V<34> | V<35> | V<36> | V<37> | V<38> | V<39> | V<40> |
| VGAMMA_H<4> | V<26> | V<27> | V<28> | V<29> | V<30> | V<31> | V<32> | V<33> |
| VGAMMA_L<4> | V<25> | V<26> | V<27> | V<28> | V<29> | V<30> | V<31> | V<32> |
| VGAMMA_H<3> | V<18> | V<19> | V<20> | V<21> | V<22> | V<23> | V<24> | V<25> |
| VGAMMA_L<3> | V<17> | V<18> | V<19> | V<20> | V<21> | V<22> | V<23> | V<24> |
| VGAMMA_H<2> | V<10> | V<11> | V<12> | V<13> | V<14> | V<15> | V<16> | V<17> |
| VGAMMA_L<2> | V<9> | V<10> | V<11> | V<12> | V<13> | V<14> | V<15> | V<16> |
| VGAMMA_H<1> | V<2> | V<3> | V<4> | V<5> | V<6> | V<7> | V<8> | V<9> |
| VGAMMA_L<1> | V<1> | V<2> | V<3> | V<4> | V<5> | V<6> | V<7> | V<8> |

It can be seen that each ramp voltage curve includes $2^k$ initial grayscale voltages.

Then the $2*2^m$ ramp voltage curves generated above generate, through the buffer, $2*2^m$ buffer ramp voltage curves, VGAMMA_H_BUF<1>-VGAMMA_H_BUF<8>, VGAMMA_L_BUF<1>-VGAMMA_L_BUF<8>, which are sent to the source operational amplifier, that is, an upper half part of FIG. 7.

Figure 7C:
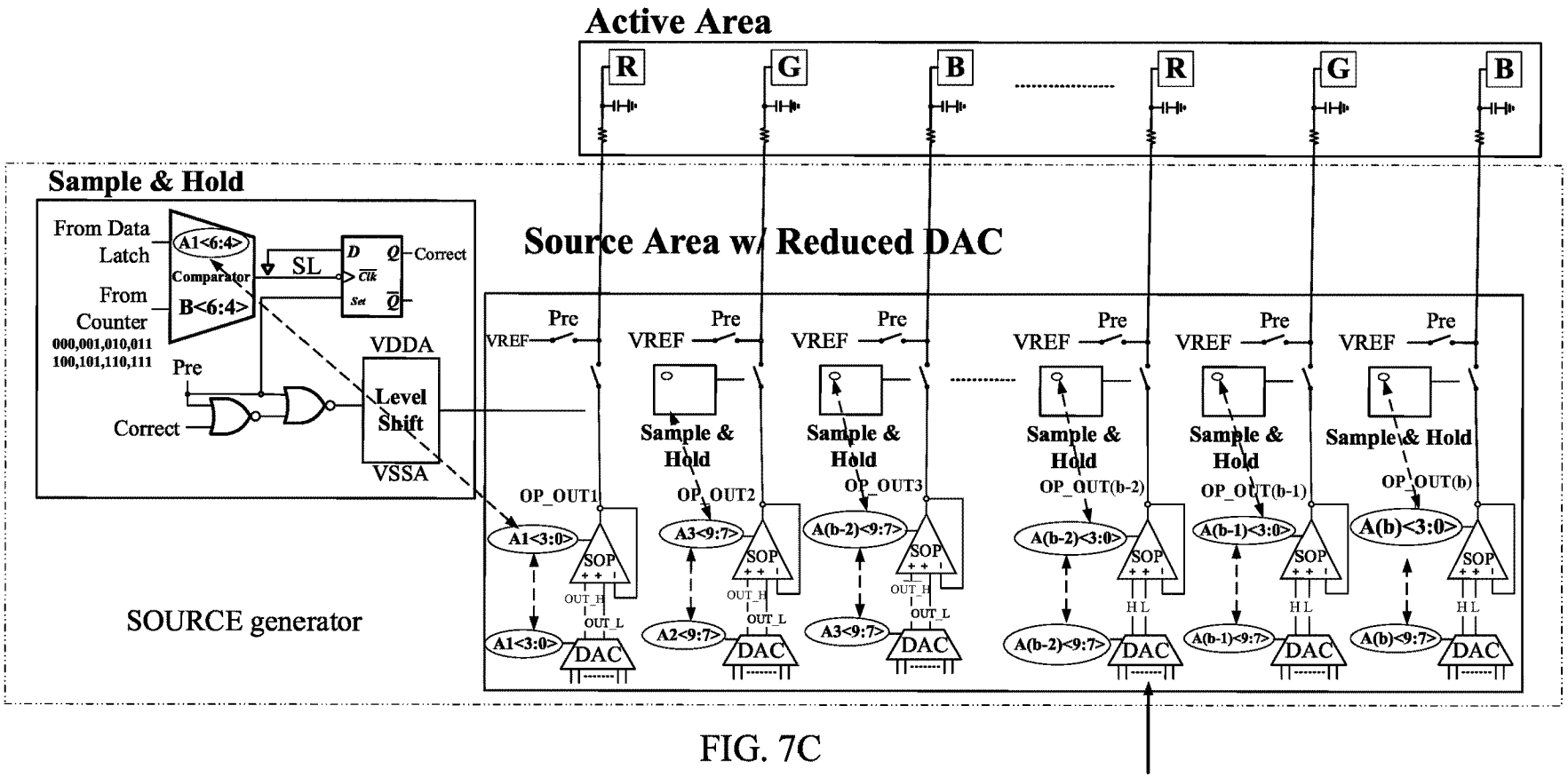

An upper half part of FIG. 7 illustrates a source driving part, and an enlarged schematic diagram of the source driving part is shown in FIG. 7C, which mainly includes a multiplexer, an interpolation driving operational amplifier, and a digital comparator. Take the source driving circuit in the first column as an example, first 3-bit data of the pixel data corresponding to the data signal input terminal of the pixel circuit in the first column is configured as $7^{th}$-$9^{th}$-bit data A1<9:7> of A1, which is as a control signal to select adjacent two voltages VGAMMA_H_BUF and VGAMMA_L_BUF.

Last 4-bit data of the pixel data inputted from the first column of data signal input terminals, that is, a $0^{th}$-$3^{rd}$-bit data A1<3:0> of A1 is adopted as a control signal of the interpolation driving operational amplifier to generate 16 grayscale voltages between the voltages VGAMMA_H_BUF and VGAMMA_L_BUF.

In this way, the 7-bit data of the pixel data, that is, the first 3-bit data and the last 4-bit data, determines an only one set of step voltages, and then a comparison result of A1<6:4> and B<6:4> controls, through a level conversion circuit, whether a switch connected to an output of the source operational amplifier and a data signal input terminal of the first column of pixel circuits is turned off. A1<6:4> is middle 3-bit data of the pixel data corresponding to the data signal input terminal of the first column of pixel circuits, that is, the $4^{th}$-$6^{th}$-bit data of A1, and B<6:4> is a value of a digital register that is constantly jumping.

It is assumed that when A1<6:4> is different from B<6:4>, the comparison result is low, the switch is in an off state, an enable signal of the source operational amplifier is low, and the source operational amplifier is in an inactive state, at this time, B<6:4> jumps from 000 to 111. In this process, when B<6:4> changes to be the same as A1<6:4>, the comparison result becomes high, the switch is turned on, and the enable signal of the source operational amplifier becomes high, the source operational amplifier starts to work and generates a grayscale voltage corresponding to A1<9:0> at this moment, which is then sent to a data signal input terminal of the first column of pixel circuits; when B<6:4> jumps again, A1<6:4> is different from B<6:4>, the comparison result is low and the switch is turned off, at this time, the gray-scale voltage is maintained by a capacitor in the pixel circuit for display.

As shown in FIG. 7, an active area of the display panel is provided with N columns of pixel circuits. A data signal input terminal of each column of pixel circuits is connected to an output terminal of the source operational amplifier in a one-to-one correspondence. Similar to a process in which the source operational amplifier sends the grayscale voltage to the first column of pixel circuits, the source operational amplifier generates the grayscale voltages corresponding to the first column of pixel circuits to the $N^{th}$ column of pixel circuits, and sends the grayscale voltage to a data signal input terminal for a corresponding pixel circuit at corresponding time.

An embodiment of the present disclosure further provides a display device including a display panel and the driving system for the display panel as described above.

Specifically, the display panel may be an OLED display panel or a liquid crystal display panel.

For the display device provided by this embodiment of the present disclosure, the driving system adopts the configuration of hybrid source gamma. When the pixel data is a (k+m+n)-bit data, in which k-bit data is configured to generate $2^k$ step voltages, m-bit data is configured to select any two adjacent buffer ramp voltage curves, and n-bit data is configured to perform interpolation and voltage dividing to generate additional $2^n$ ramp voltage curves, only $(2^m+1)$ voltage wire channels are required in the source operational amplifier. The time occupied by each step voltage is (display time for 1 row of sub-pixels)/$2^k$, which is much smaller than an area occupied by the conventional source gamma configuration, and the area of the digital-to-analog converter and data latch is saved. Moreover, the time occupied by each step voltage is much longer than that of the conventional ramp source gamma configuration, and the requirements on time is much lower, which makes it suitable for high-resolution display products. Further, if the hybrid source gamma configuration in this embodiment is adopted to achieve the RGB independent gamma curve, three sets of gamma generating circuits are required, which are respectively sent to the pixel driving operational amplifier circuit of RGB. In this way, a wire channel with $3*(2^m+1)$ wires is required in the source operational amplifier, which is much smaller than that of the conventional source gamma configuration. Therefore, the hybrid source gamma configuration in this embodiment can be adopted to achieve the RGB independent gamma. In this way, no additional data processing is required for digitals to achieve untrue RGB independent gamma, which reduces digital information processing, thereby reducing the bits and the power consumption of the overall chip.

The above description illustrates preferred embodiments of the present disclosure. It should be noted that without departing from a principle described in the present disclosure, a person skilled in the art may make improvements and amendments, which shall all be within the protection scope of the present disclosure.

What is claimed is:

1. A driving system for a display panel, wherein the display panel comprises a pixel circuit comprising a plurality of columns of data signal input terminals, and the driving system comprises:

a voltage generating circuit configured to generate $(2^{m+k}+1)$ initial grayscale voltages;

a ramp voltage curve generating circuit configured to generate $(2^m+1)$ ramp voltage curves by using the $(2^{m+k}+1)$ initial grayscale voltages based on k-bit data of received pixel data, wherein each ramp voltage curve of the $(2^m+1)$ ramp voltage curves comprises $2^k$ step voltages;

a source driving circuit configured to generate additional $2^n$ ramp voltage curves by using any two adjacent ramp voltage curves of the $(2^m+1)$ ramp voltage curves based on m-bit data of the received pixel data; and an output control circuit configured to select a grayscale voltage of the ramp voltage curves based on the received pixel data and send the selected grayscale voltage to the data signal input terminals of the pixel circuit.

2. The driving system for the display panel according to claim 1, further comprising: a buffer configured to buffer the $(2^m+1)$ ramp voltage curves and to output $(2^m+1)$ buffer ramp voltage curves;

wherein the source driving circuit is configured to select any two adjacent buffer ramp voltage curves from the $(2^m+1)$ buffer ramp voltage curves based on the m-bit data of the received pixel data, and to perform interpolation and voltage dividing on the selected two buffer ramp voltage curves based on n-bit data of the received pixel data to generate additional $2^n$ ramp voltage curves.

3. The driving system for the display panel according to claim 1, wherein the ramp voltage curve generating circuit is configured to form a first ramp voltage curve by using $1^{st}$, $(1+2^k)^{th}$, . . . , $(1+2^k*(2^m-1))^{th}$ initial grayscale voltages; to form a second ramp voltage curve by using $2^{nd}$, $(2+2^k)^{th}$, . . . , $(2+2^k*(2^m-1))^{th}$ initial grayscale voltages; . . . ; and to form a $(2^m+1)^{th}$ ramp voltage curve by using $(2^m+1)^{th}$, $(2^m+1+2^k)^{th}$, . . . , $(2^m+1+2^k*(2^m-1))^{th}$ gray scale voltages.

4. The driving system for the display panel according to claim 2, wherein the source driving circuit comprises:

a multiplexer configured to select an $(x+1)^{th}$ buffer ramp voltage curve and an $(x+2)^{th}$ buffer ramp voltage curve when a decimal number corresponding to the m-bit data is x.

5. The driving system for the display panel according to claim 4, wherein the source driving circuit further comprises:

an interpolation voltage dividing circuit configured to generate a grayscale voltage $(y*OUT_H+(2^n-y)*OUT_L)/2^n$ when a decimal number corresponding to the n-bit data is y, where OUT_H is the $(x+2)^{th}$ buffer ramp voltage curve, and OUT_L is the $(x+1)^{th}$ buffer ramp voltage curve.

6. The driving system for the display panel according to claim 1, wherein the output control circuit comprises:

a comparator configured to compare a k-bit data of the pixel data in one column of data signal input terminals of the plurality of columns of data signal input terminals with a value of a digital register that is jumping; and a controller configured to send a grayscale voltage corresponding to (m+n)-bit data of the pixel data to the data signal input terminals when the k-bit data is identical to the value of the digital register.

7. The driving system for the display panel according to claim 1, wherein the pixel data comprises (k+m+n)-bit data.

8. The driving system for the display panel according to claim 7, wherein the k-bit data is first k-bit data, the m-bit data is middle m-bit data, and the n-bit data is last n-bit data.

9. The driving system for the display panel according to claim 7, wherein the k-bit data is middle k-bit of data, the m-bit data is first m-bit data, and the n-bit data is last n-bit data.

10. The driving system for the display panel according to claim 7, where k=3, m=3, and n=4.

11. A display device, comprising a display panel and the driving system for the display panel according to claim 1.

12. The display device according to claim 11, wherein the display panel is an OLED display panel or a liquid crystal display panel.

13. The display device according to claim 11, wherein RGB gamma voltage curves of the display device are independent from each other.

* * * * *